US008070394B2

(12) United States Patent
Skarbovig

(10) Patent No.: US 8,070,394 B2
(45) Date of Patent: Dec. 6, 2011

(54) VERSATILE GROUT BAG TYPE OF UNDERGROUND SUPPORT

(76) Inventor: Nils Mittet Skarbovig, Vredenburg (ZA)

( * ) Notice: Subject to any disclaimer, the term of this patent is extended or adjusted under 35 U.S.C. 154(b) by 110 days.

(21) Appl. No.: 12/523,014

(22) PCT Filed: Jan. 18, 2008

(86) PCT No.: PCT/IB2008/000109

§ 371 (c)(1),
(2), (4) Date: Jul. 13, 2009

(87) PCT Pub. No.: WO2008/087538

PCT Pub. Date: Jul. 24, 2008

(65) Prior Publication Data

US 2010/0135732 A1 Jun. 3, 2010

(30) Foreign Application Priority Data

Jan. 18, 2007 (ZA) ..... 2007/00518

(51) Int. Cl.
*E21D 15/00* (2006.01)

(52) U.S. Cl. ..... 405/289; 299/11

(58) Field of Classification Search ..... 405/288, 405/289; 248/354.1, 354.2; 299/11, 12
See application file for complete search history.

(56) References Cited

U.S. PATENT DOCUMENTS

| | | | | | |
|---|---|---|---|---|---|
| 4,195,111 | A * | 3/1980 | Rautenbach | 405/288 |
| 4,983,077 | A * | 1/1991 | Sorge et al. | 405/288 |
| 5,143,340 | A * | 9/1992 | Wood et al. | 405/289 |
| 5,669,739 | A * | 9/1997 | Clarke | 405/289 |
| 5,823,718 | A * | 10/1998 | Du Plessis | 405/288 |
| 6,394,707 | B1 * | 5/2002 | Kennedy et al. | 405/288 |
| 6,547,492 | B1 | 4/2003 | Degville | |
| 2004/0096278 | A1 * | 5/2004 | Van Zyl | 405/289 |

FOREIGN PATENT DOCUMENTS

| | | | |
|---|---|---|---|
| AU | 9880880 | * | 3/1999 |
| DE | 2091314 | A | 7/1982 |
| DE | 29917906 | U1 | 2/2000 |
| DE | 10321340 | A1 | 12/2003 |
| GB | 2131850 | A * | 6/1984 |
| GB | 2222841 | A * | 3/1990 |
| GB | 2296517 | A | 7/1996 |
| WO | 97/47859 | A | 12/1997 |
| WO | 99/09299 | A | 2/1999 |
| WO | 03/085234 | A | 10/2003 |
| ZA | 2000/05805 | B1 | 7/2001 |

* cited by examiner

*Primary Examiner* — Frederick L Lagman
(74) *Attorney, Agent, or Firm* — Miller, Matthias & Hull LLP

(57) ABSTRACT

A support assembly (1) is provided for the roof or hanging wall (36, 114) of an underground mine. The assembly comprises at least one support elongate (30) and a grout bag (2, 60, 80, 90, 102, 108, 120) used in association therewith and wherein the grout bag is inflated with settable granular material or grout (42). The support elongate is substantially surrounded, in plan view, by the grout bag and set granular material or grout contained therein. Preferably at least one cross-member (28) extends generally diametrically across the top of the support assembly and is anchored to the roof or hanging wall by the support elongate. The grout bag is preferably suspended from the end regions of the cross-member. Various grout bags for inclusion in such a support assembly are also provided.

10 Claims, 6 Drawing Sheets

24
28
22A
22
22
22
22
20
10
4
9
8
1
"A"
2
24
10
4
26
1
26
9
2
7
"A"
7
5

VERSATILE GROUT BAG TYPE OF UNDERGROUND SUPPORT

CROSS-REFERENCE TO RELATED APPLICATION

This is the U.S. National Phase of International Application No. PCT/IB2008/000109 filed 18 Jan. 2008, claiming priority to South African Patent Application No. 2007/00518 filed 18 Jan. 2007.

FIELD OF THE INVENTION

This invention relates to a versatile grout bag type of underground support for use in underground mining operations in order to support or contribute towards the support, of the roof or hanging wall. More particularly, the invention relates a grout bag that may be used for containing granular material that may be set solid using cementitious or other suitable material to form a so-called grout pack and that may optionally be used in combination with other underground supports of the general nature of a pole, prop or other elongate (herein generically termed "support elongate").

In this specification the term "grout bag" is intended to have its widest meaning and to include any appropriate enclosure made of a flexible material for the purpose of containing granular including solidified granular material serving as a mine roof or hanging wall support, in use.

BACKGROUND TO THE INVENTION

The support of the hanging wall in stopes is one of the most basic requirements in underground mining. Dependant on the type and quality of rock being supported, the depth of mining, the prevalent field stresses, seismicity, stopping width and a number of other factors, stope support can vary across a vast range of materials, configurations and systems. These include, amongst others, timber poles, timber and composite packs, steel props, unmined pillars, rock and granular or tailings type supports.

Among the granular support media, cemented grout packs are being increasingly used as combination support products. These consist essentially of a support column formed by cured cemented backfill, or other suitable cured cementitious grout, contained within a bag usually made of a geotextile material, which is stiffened against lateral deformation under axial load with external restraining rings. These are commonly referred to as "grout packs".

At present, grout packs are typically used in association with external timber elongate supports which are used to clamp a support net or restraining ring assembly against the hanging wall during erection and filling of the grout pack. The geotextile grout bag of the grout pack is suspended within the restraining ring assembly ready to receive pumped grout. After inflation of the grout pack the support elongates are left in place and become part of the pack assembly contributing to some extent to the compressive resistance of the pack.

However, as the pack dilates under vertical compression the support elongates may become deflected sideways thereby losing at least some of their effectiveness as complementary hanging wall supports. Also, the support elongates, in the event that they are of timber, represent a fire hazard and, furthermore, they simply represent additional physical obstructions.

OBJECT OF THE INVENTION

It is an object of this invention to provide a support assembly including a grout bag whereby difficulties perceived in existing arrangements are overcome, at least to some extent. It is another object of the invention to provide a grout bag for use in such a support assembly.

SUMMARY OF THE INVENTION

In accordance with one aspect of this invention there is provided a support assembly for the roof or hanging wall of an underground mine comprising at least one support elongate and a grout bag used in association therewith and wherein the grout bag is inflated with settable granular material or grout, the support assembly being characterised in that the support elongate is substantially surrounded, in plan view, by the grout bag and set granular material or grout contained therein.

Further features of this aspect of the invention provide for the support assembly to include at least one cross-member extending generally diametrically across the top of the support assembly and anchored to the roof or hanging wall by said at least one support elongate; for the end regions of the cross member to carry at least an uppermost support ring from which the grout bag is suspended preparatory to filling same; for a series of vertically spaced restraining rings typically interconnected by a diagonal flexible knotted mesh of polymer yarns or braids to be suspended from the uppermost support ring to provide an outer circumferential support structure for the grout bag; and for the support elongate to extend either through a passage formed through the grout bag from bottom to top for there to be a plurality of separate grout bags extending from bottom to top and arranged to form a substantially continuous mass of settable granular material or grout about the support elongate to substantially enclose it and wherein any spaced confining rings encircle all of the plurality of grout bags and the grout bags together form a generally cylindrical support.

In accordance with a second aspect of the invention there is provided a grout bag having a top, a bottom and at least one side and having, in an expanded condition, an axis extending between the top and bottom thereof, the grout bag being characterised in that it is shaped to provide, in the inflated condition, a passage configured to be capable of accommodating at least a part of the outer surface of a support elongate extending in the same general direction as the said axis between the top and bottom of the grout bag.

The passage may extend coaxially through the length of the bag between the top and bottom. In such an instance the passage may be defined by a small diameter tube and the bag itself by a larger diameter tube with the two tubes being connected at each end by an annular end piece. Alternatively, a generally cylindrical bag may be constructed from sheet material that may have a seam extending longitudinally. Further alternatively, the bag may be instructed so that the passage is accessible by way of a slot in the bag construction so that the bag can be introduced laterally over a support elongate already in position between a footwall and hanging wall.

A still further alternative is for the bag to be a composite grout bag composed of a plurality of cooperating grout bags of generally sector shape in cross-section so that together they define a generally cylindrical bag assembly. Typically two or three of such cooperating grout bags would be employed in which instance a specific passage formation is not required as the cooperating grout bags would deform to accommodate the support elongate between them. In such an instance the plurality of cooperating grout bags would typically be filled/inflated simultaneously. The invention therefore provides a grout bag of generally sector shape in cross-section so that the grout bag may be used together with cooperating grout bags to operatively define a generally cylindrical grout bag assembly As a still further alternative, the bag may be made to a generally rectilinear configuration so as to be capable of being wound around an installed support elongate and secured in a position in which it envelops the support elongate.

As an alternative to the passage being coaxial with the bag, in appropriate instances the passage may be offset to one side or inclined between the top and bottom.

In all instances, the grout bag or plurality of cooperating grout bags may be provided with ties for holding any appropriate parts together.

In order that the above and other features of the invention may be more fully understood, various embodiment thereof will now be described with reference to the accompanying drawings.

DETAILED DESCRIPTION WITH REFERENCE TO THE DRAWINGS

Figures 1, 2:
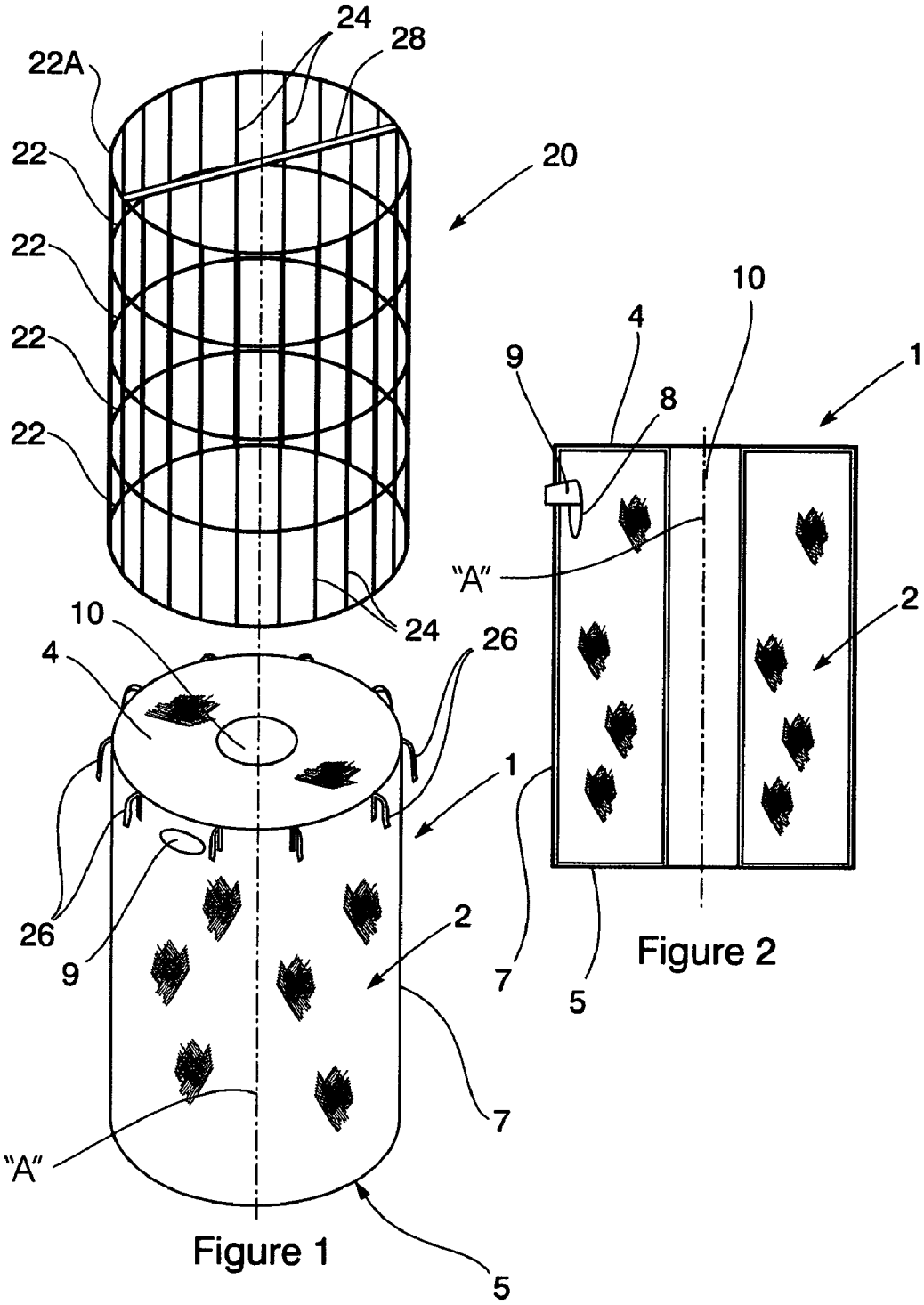
FIG. 1 is an exploded perspective view of the main components of one embodiment of an underground-support assembly according to the invention and illustrating one embodiment of grout bag.
FIG. 2 is a sectional side elevation of the components illustrated in FIG. 1.

In the embodiment of the invention illustrated in FIGS. 1 and 2 an underground support assembly (1) includes an inflatable grout bag (2) made of a flexible geotextile material. The inflatable grout bag (2) has a cylindrical shape with a top (4), bottom (5) and side (7) and an inlet (9) which includes a unidirectional valve (8) provided in the side (7) near the top (4), and an axis "A". The unidirectional valve (8) is, in this embodiment, simply formed by a tube made of a flexible material which extends internally of the inflatable bag (2) and which is collapsed in its normal condition. Such valves are well known.

As provided by this invention, a passage (10) is provided through the inflatable bag (2) between the top (4) and bottom (5). In this embodiment, the passage (10) is co-axial with the inflatable bag (2) and thus extends centrally between the top (4) and bottom (5). In one form, the grout bag may be constructed as an inner small diameter tube that extend coaxially within a larger diameter outer tube defining the outer walls of the grout bag with the two tubes being interconnected at the top and bottom by appropriate annular top and bottom panels.

A restraining assembly (20) is further provided within which the grout bag (2) fits. The restraining assembly (20) includes a plurality of axially spaced hoops (22) that may be joined about their circumference by longitudinally extending webs or mesh (24).

Ties (26) are provided about the circumference of the top (4) of the grout bag (2) and are secured, in use, to the uppermost ring (22A) of the restraining assembly (20). A cross-member (28), made in this embodiment from a length of flat iron, is secured to the uppermost ring (22A) to extend dimetrically thereacross. The cross-member (28) thus extends over the passage (10) in the operative position.

Figure 3:
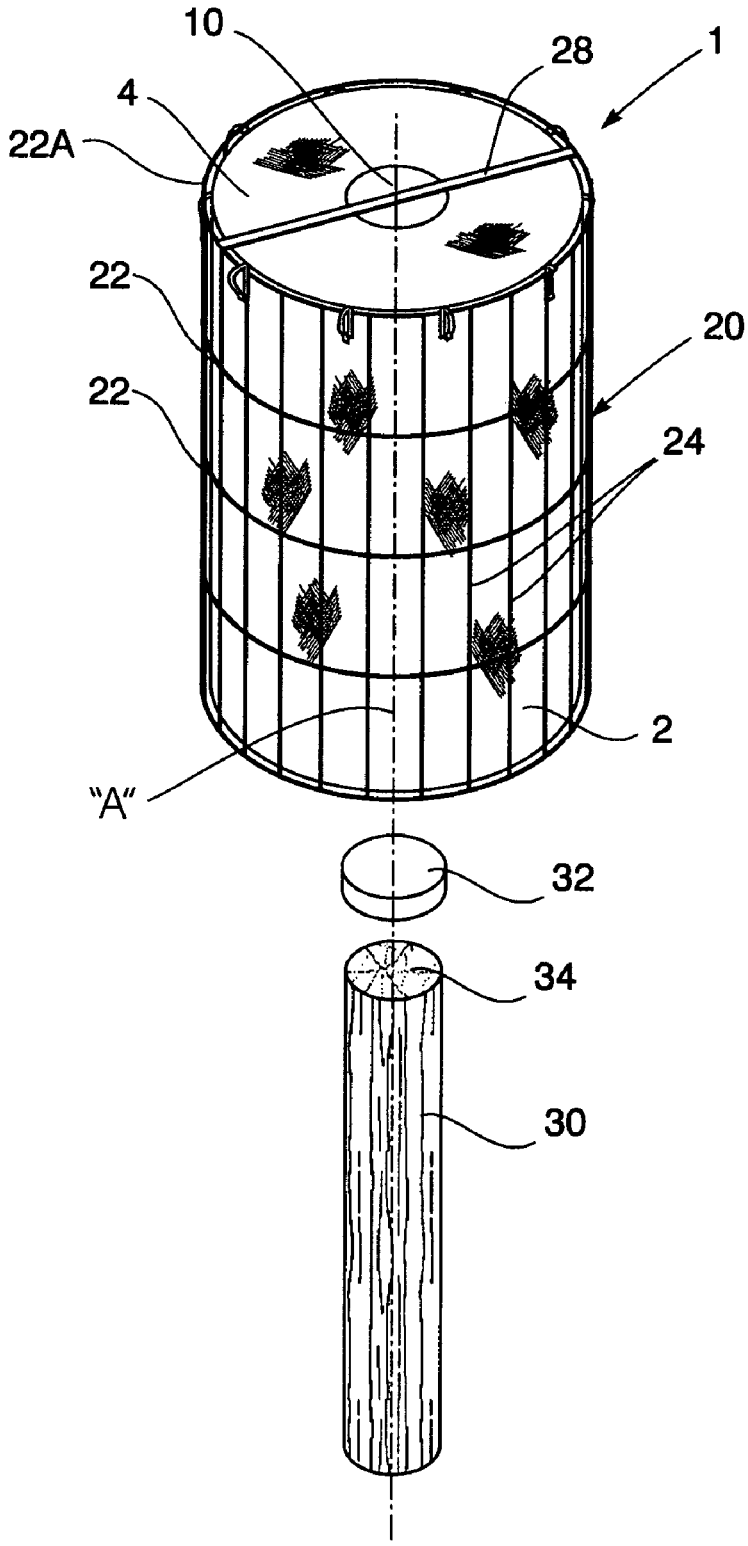
FIG. 3 is an exploded perspective view of the composite underground support illustrated in FIG. 1.
Figure 4:
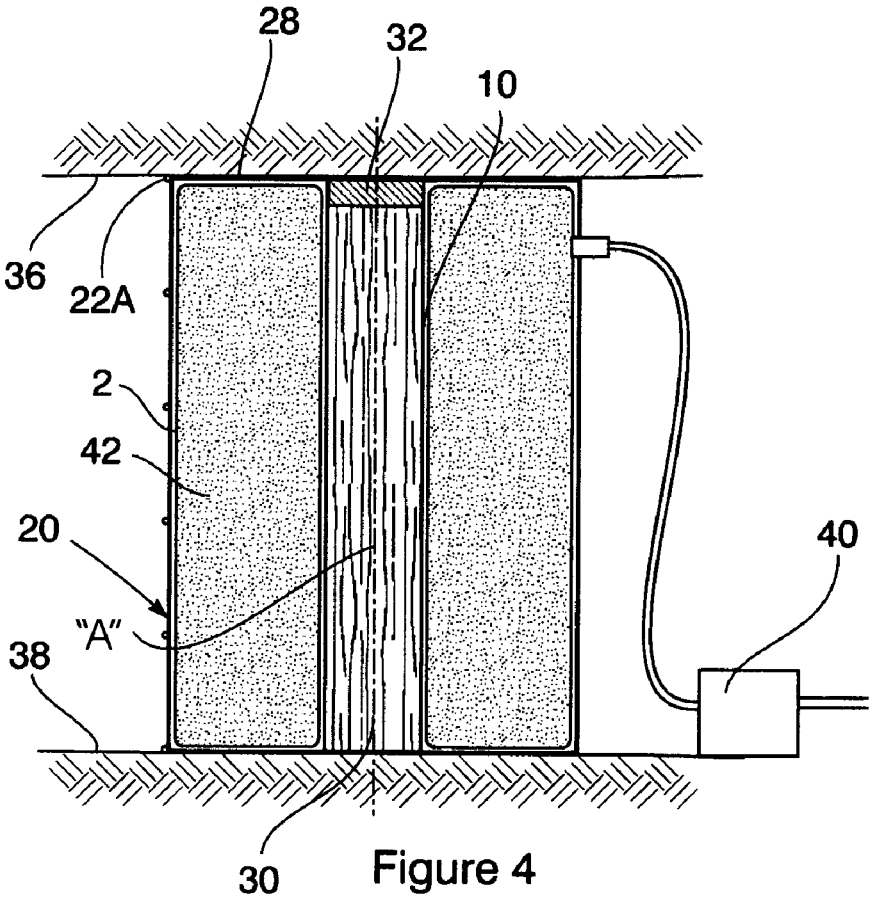
FIG. 4 is a part-sectional side elevation of an underground support assembly of the type illustrated in FIGS. 1 to 3 in use in a stope.
Figure 5:
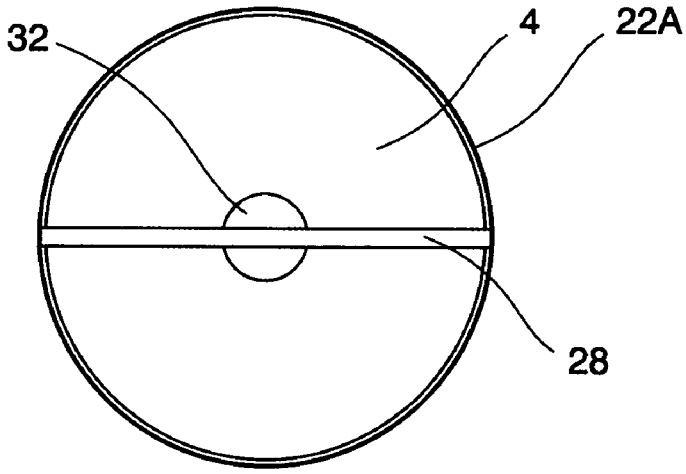
FIG. 5 is a plan view of the underground support illustrated in FIG. 4.

As shown in FIGS. 3 to 5, the passage (10) is shaped to receive a support elongate (30), in this embodiment a timber pole, therein. In use, the pole (30) is inserted into the passage (10) with a pre-stressing device (32) located between the top (34) of the pole (30) and the cross-member (28). The pre-stressing device (32) is of a type well known in the art being essentially an hydraulically expandable steel container. Typically, water is used to operate the device and cause it to expand axially.

With the pole (30) located within the inflatable bag (2) it is positioned as required between a hanging wall (36) and a foot wall (38). In this condition, the cross-member (28) extends between the hanging wall (36) and pre-stressing device-(32) with the restraining assembly (20) depending therefrom and the inflatable bag (2) in turn depending from the uppermost ring (22A) of the restraining assembly (20). Hereafter, the pre-stressing device (32) is inflated to its operating pressure causing the pole to become firmly secured between the hanging wall (36) and foot wall (38) and offering immediate support to the hanging wall (36).

A pump (40) is then used to fill the inflatable bag (2) with a suitable slurry (42), in this embodiment a cementitious grout, in conventional fashion. After filling, the grout (42) is allowed to set, again in a conventional fashion.

The underground support (1) has a number of advantages over the prior art. Firstly, it requires the use of only one support elongate, rather than two or more. Secondly, the underground support is faster to erect than prior art products. Thirdly, as the support elongate is confined within the cemented grout, it has substantially higher support resistance than an external, unconfined support elongate. Fourthly, the support resistance of the confined elongate element remains high over the entire life of the underground support and fifthly, there is a reduced fire hazard as no timber is exposed.

It will be appreciated that many other embodiments of an underground support exist which fall within the scope of the invention particularly as regards the shape and configuration of the inflatable grout bag.

Figure 6:
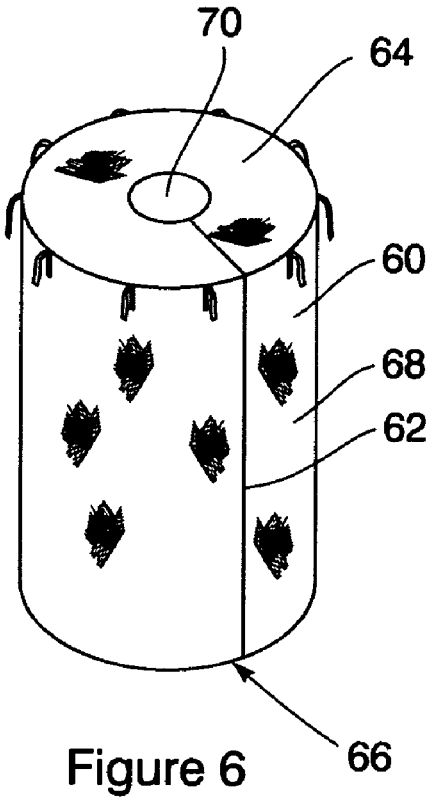
FIG. 6 is a perspective view of a second embodiment of grout bag for use in the underground support according to the invention.
Figure 7:
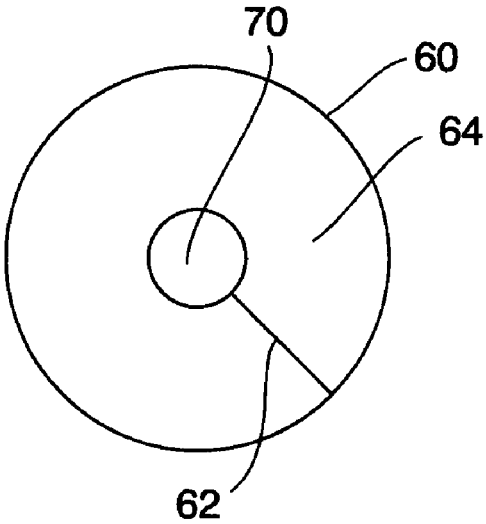
FIG. 7 is a top plan view of the grout bag illustrated in FIG. 6.

Thus, as shown in FIGS. 6 and 7, the inflatable bag (60) could have a sewn construction with a seam (62) extending radially across the top (64) and bottom (66) and longitudinally along the side (68) and within the passage (70).

Figure 8:
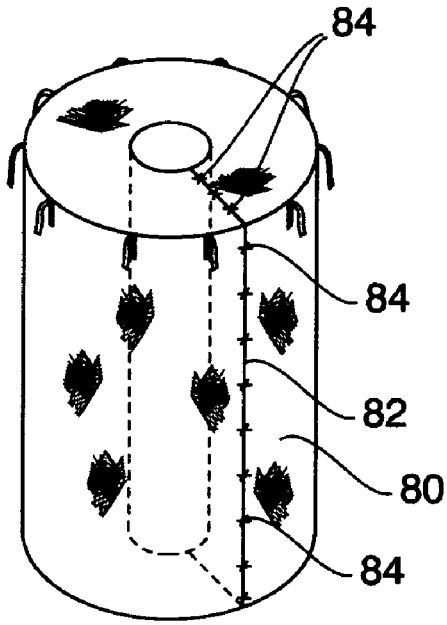
FIG. 8 is a perspective view of a third embodiment of an inflatable grout bag for use with the underground support illustrated in FIG. 1.
Figure 9:
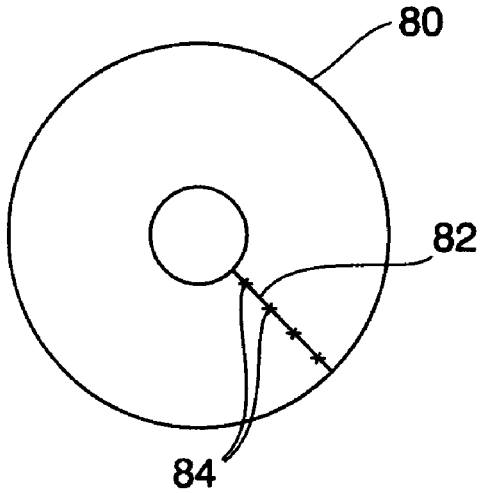
FIG. 9 is a top plan view of the inflatable grout bag illustrated in FIG. 8.

Alternatively, as shown in FIGS. 8 and 9, the inflatable bag (80) could have a cylindrical shape with a central passage therethrough and a radially extending longitudinal split to provide a pair of closed ends which operatively abut and are secured together using ties (84). The inflatable bag (80) could thus be opened and wrapped around an elongate support element from a laterally offset position and then the ends secured together using the ties (84). This may be useful where elongate support elements are already in position and it is required to provide additional support.

Figure 10:
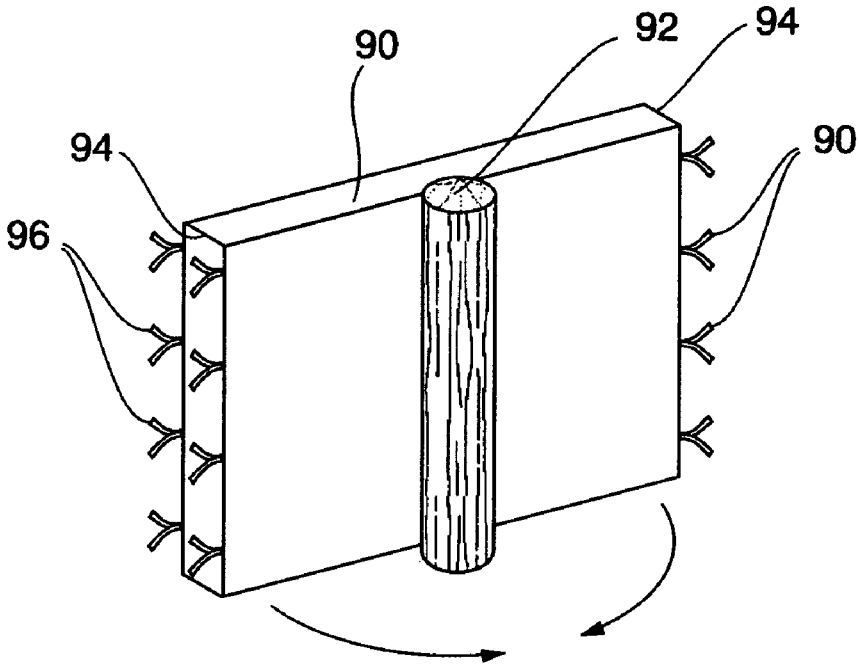
FIG. 10 is a perspective view of a fourth embodiment of a grout bag and support elongate.

As shown in FIG. 10, the inflatable bag (90) could have a rectilinear rectangular shape which can be wrapped about a support elongate (92) and the adjoining ends (94) secured together using ties (96) similarly to the embodiment illustrated in FIGS. 8 and 9. In this embodiment, however, the elongate support element (92) simply deforms the inflatable bag (90) avoiding the necessity of having to specifically provide a shaped passage in the inflatable bag (92).

Figure 11:
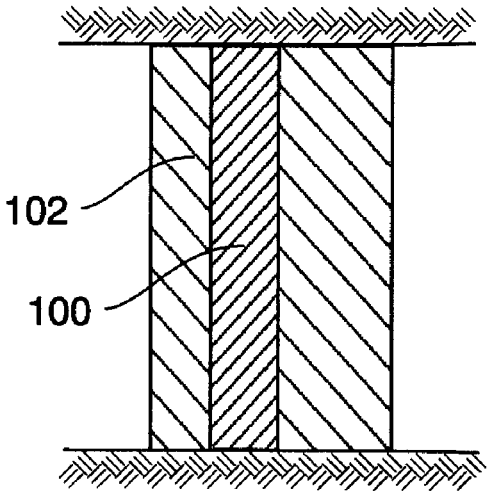
FIG. 11 is a sectional side elevation of a fifth embodiment of an underground support element in use.
Figure 12:
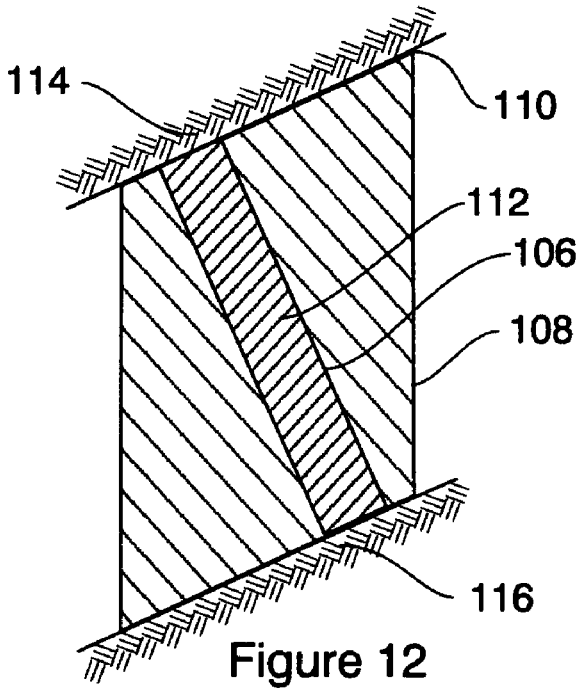
FIG. 12 is a sectional side elevation of a sixth embodiment of an underground support element in use.

Referring to FIGS. 11 to 12, it will be noted that the passage need not be centrally located within the bag nor that it extend parallel to the axis thereof. As shown in FIG. 11, the passage (100) could be parallel to but offset from the axis of the bag (102). As shown in FIG. 12, the passage (106) could be inclined within the inflatable bag (108). This may be useful in inclines where the inflatable bag (108) will depend from the ring (110) under gravity in a vertical fashion whilst the elongate support element (112) which extends normally between the hanging wall (114) and foot wall (116) will be inclined to the vertical.

Figure 13:
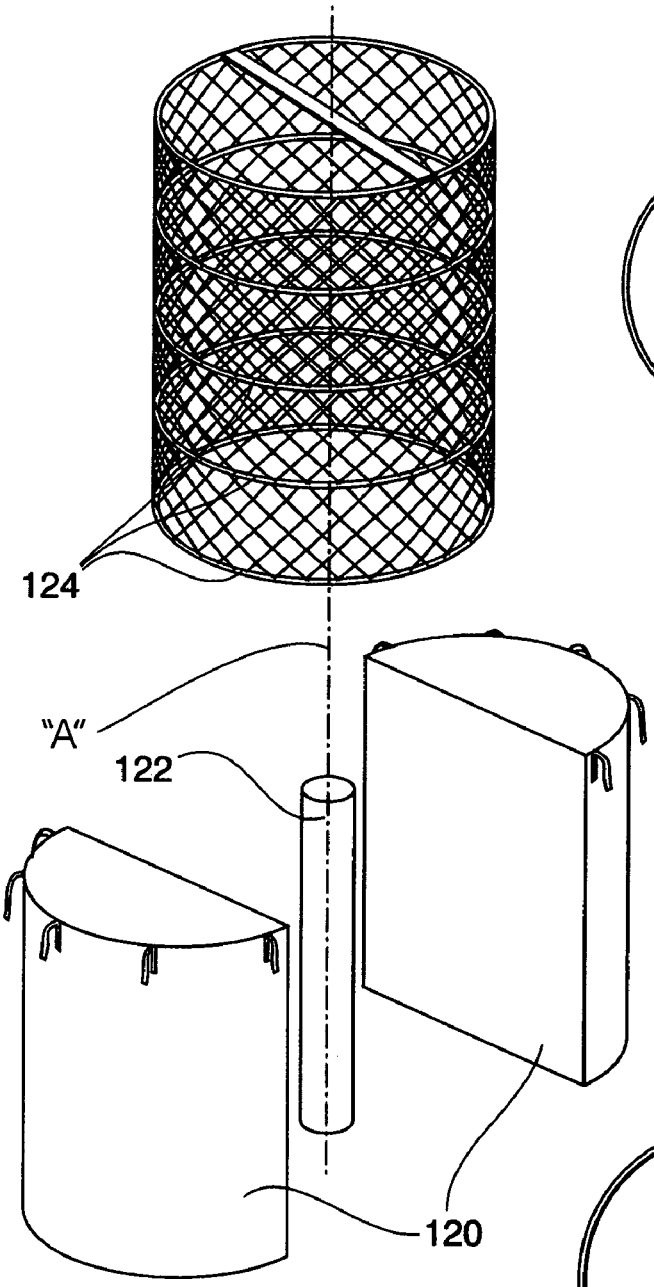
FIG. 13 is a schematic exploded isometric view of a seventh embodiment of an underground support assembly.
Figure 14:
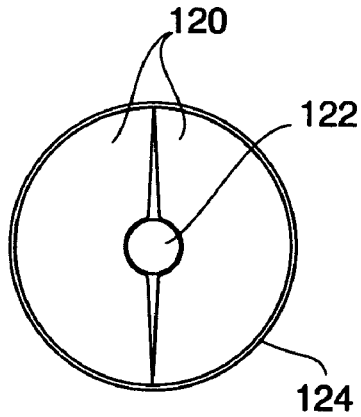
FIG. 14 is a schematic plan view thereof in the assembled condition with the cooperating grout bags in an uninflated condition; and, FIG. 15 is the same as FIG. 14 that with the cooperating grout bags in an inflated condition.
Figure 15:
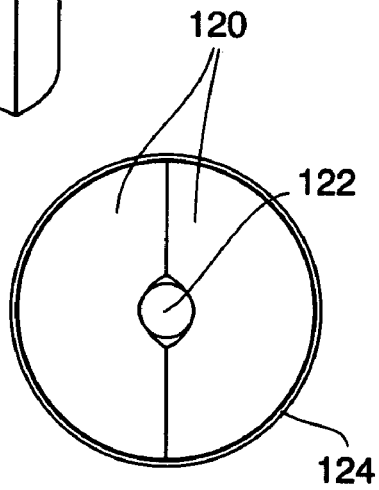

A still further alternative, as illustrated in FIGS. 13 to 15, is for the bag to be composed of a plurality of cooperating grout bags (120) of generally sector shape in cross-section, in this instance semicircular, so that together they define a generally cylindrical bag assembly. In this instance a specific passage formation is not required as the cooperating grout bags would deform to accommodate the support elongate (122) between them. FIG. 14 illustrates schematically in plan view the assembled support assembly before the bags are inflated with cementitious grout and FIG. 15 illustrates the way in which the filled cooperating grout bags envelop the support elongate after inflation. In such an instance the plurality of cooperating grout bags would typically be inflated simultaneously in order to avoid a lateral force being exerted on either the restraining assembly including restraining rings (124) or on the support elongate. To this end the grout bags could be supplied with means for allowing flow communication of grout between them. However, it may be advantageous in many circumstances to inflate these separately, for instance where used in an incline where there will be a tendency for the bags to lean down slope under gravity. In this example, the lowermost grout bag could be inflated first and the other or others thereafter.

Clearly, any suitable material can be used in the construction of the inflatable grout bag and the inflatable bag may include an internal bladder.

Furthermore, any suitable re-enforcing about the inflatable bag can be used should this be desired. The bag could have any convenient configuration and need not be cylindrical Also, more than one passage can be provided through the bag should it be desired. Furthermore, the passage need not extend fully through the inflatable bag and may be blind.

The invention claimed is:

1. A support assembly for providing support between a foot wall and a hanging wall of an underground mine comprising:

at least one support elongate;

a grout bag having a top operatively associated with the hanging wall, a bottom operatively associated with the foot wall, and sides interconnecting the top and bottom, the grout bag defining an interior inflatable with settable granular material or grout pumped into the interior through an inlet, wherein the support elongate extends through a passage formed through the grout bag from bottom to top, and wherein the inflated grout bag extends from the bottom at the foot wall to the top at the hanging wall so that an entire length of the support elongate is substantially surrounded, in plan view, by the grout bag and a substantially continuous mass of set granular material or grout contained therein; and a series of vertically spaced restraining rings operatively encircling the sides of the grout bag to provide outer circumferential support for the grout bag.

2. A support assembly as claimed in claim 1 in which the support assembly includes at least one cross-member extending generally diametrically across the top of the support assembly and anchored to the roof or hanging wall by said at least one support elongate.

3. A support assembly as claimed in claim 2 in which the end regions of the cross member carry at least an uppermost support ring from which the grout bag is suspended preparatory to filling same.

4. A support assembly as claimed in claim 3 in which the series of vertically spaced restraining rings are suspended from the uppermost support ring to provide an outer circumferential support structure for the grout bag.

5. A support assembly for providing support between a foot wall and a hanging wall of an underground mine comprising:

at least one support elongate; and a plurality of separate grout bags, each grout bag having a top operatively associated with the hanging wall, a bottom operatively associated with the foot wall, and sides interconnecting the top and bottom, each grout bag defining an interior inflatable with settable granular material or grout pumped into the interior through an inlet to place the grout bag in an expanded condition, and wherein each separate grout bag in the expanded condition extends from the foot wall to the hanging wall, the plurality of separate grout bags being arranged to form a substantially continuous mass of settable granular material or grout that surrounds an entire length of the support elongate from the foot wall to the hanging wall.

6. A support assembly as claimed in claim 5 in which a series of spaced restraining rings encircle the continuous mass defined by the plurality of grout bags by extending around the sides of the plurality of grout bags, and the grout bags together form a generally cylindrical support.

7. A support assembly as claimed in claim 5, in which each grout bag has a generally sector shape in cross-section, so that the plurality of grout bags may be arranged in a cylindrical array.

8. A support assembly as claimed in claim 5, in which each grout bag further comprises at least one tie.

9. A support assembly as claimed in claim 8, in which the at least one tie is configured to secure a portion of the grout bag.

10. A support assembly as claimed in claim 8, in which the at least one tie is configured to suspend the grout bag by an upper region of the grout bag.

* * * * *